US008266942B2

(12) United States Patent
Zhou et al.

(10) Patent No.: US 8,266,942 B2
(45) Date of Patent: Sep. 18, 2012

(54) BENDING MACHINE

(75) Inventors: Shu-Wei Zhou, Shenzhen (CN); Teng-Chiao Shen, Taipei Hsien (TW)

(73) Assignees: Hong Fu Jin Precision (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 357 days.

(21) Appl. No.: 12/621,638

(22) Filed: Nov. 19, 2009

(65) Prior Publication Data

US 2011/0072878 A1 Mar. 31, 2011

(51) Int. Cl.

| | |
|---|---|
| ***B21J 13/04*** | (2006.01) |
| *B21D 5/02* | (2006.01) |
| *B21D 9/05* | (2006.01) |
| *B21D 31/00* | (2006.01) |
| *B21D 37/00* | (2006.01) |

(52) U.S. Cl. ..... 72/455; 72/380; 72/389.4; 72/482.91; 72/482.92

(58) Field of Classification Search ..... 72/380, 72/386, 389.1, 389.3, 389.4, 446, 448, 455, 72/465.1, 466.9, 481.1, 482.91, 482.92
See application file for complete search history.

(56) References Cited

U.S. PATENT DOCUMENTS

| | | | | |
|---|---|---|---|---|
| 444,595 | A * | 1/1891 | Kennedy | 72/466.8 |
| 2,449,647 | A * | 9/1948 | Fitzgerald | 72/407 |
| 2,807,177 | A * | 9/1957 | Terhune | 72/435 |
| 2,975,701 | A * | 3/1961 | Munschauer, Jr. et al. | 100/214 |
| 3,683,657 | A * | 8/1972 | Davies | 72/112 |
| 4,317,357 | A * | 3/1982 | Moen | 72/438 |
| 5,572,899 | A * | 11/1996 | Balaity et al. | 72/413 |
| 7,325,435 | B2 * | 2/2008 | Hamel et al. | 72/370.04 |
| 7,584,640 | B1 * | 9/2009 | Liu et al. | 72/389.3 |
| 2003/0033846 | A1 * | 2/2003 | Runk et al. | 72/481.1 |
| 2007/0056347 | A1 * | 3/2007 | Leland | 72/481.1 |
| 2007/0056348 | A1 * | 3/2007 | Leland | 72/481.1 |

FOREIGN PATENT DOCUMENTS

| | | |
|---|---|---|
| CN | 201249240 Y | 6/2009 |
| JP | 2006259965 | 9/2006 |
| TW | M351748 U | 3/2009 |

OTHER PUBLICATIONS

Mechanisms, Linkages, and Mechanical Controls, edited by Nicholas P. Chironis (Associate Editor, Product Engineering), McGraw-Hill Book Company, New York, San Francisco, toronto, London, Sydney, copyrght (c) 1965 by McGraw-Hill, Inc., pp. 152 & 153.*

* cited by examiner

*Primary Examiner* — Edward Tolan
*Assistant Examiner* — Lawrence J Averick
(74) *Attorney, Agent, or Firm* — Altis Law Group, Inc.

(57) ABSTRACT

A bending machine includes an operating platform, a lower die clamp received on the operating platform, an upper die holder, and an upper die clamp. The upper die holder includes a main body, a positioning pin, a spring, and an operating rod. The main body includes a lower surface and two opposite side surfaces, the lower surface defines a sliding groove having a bottom surface with a positioning hole defined thereon. One of the two opposite side surfaces defines a sliding slot communicating with the positioning hole. The spring and the positioning pin are received in the positioning hole in sequence. The operating rod is received in the sliding slot with one end received in the latching hole and the other end extending out of the sliding slot. The upper die clamp is slidable in the sliding groove and defines a pinhole corresponding to the positioning pin.

15 Claims, 5 Drawing Sheets

BENDING MACHINE

BACKGROUND

1. Technical Field

The present disclosure relates to bending machines, and particularly, to a bending machine that provides convenient replacement of an upper die thereof.

2. Description of Related Art

A frequently used bending machine includes an upper die holder securing an upper die clamp thereon and an operating platform receiving a lower die clamp thereon. The upper die clamp fixes an upper bending die, and the lower die clamp clamps a lower bending die. Often, a die clamp can only can clamp one type of bending die, such that when a bending die is to be replaced, the corresponding die clamp must also be changed. The upper die clamp, however, is often secured on the upper die holder by screws or other fasteners, and, as a result, is difficult to remove to effect the change in dies.

What is needed, therefore, is a bending machine providing convenient replacement of an upper bending die thereof to overcome or at least mitigate the described limitations.

BRIEF DESCRIPTION OF THE DRAWINGS

Many aspects of the present bending machine can be better understood with reference to the accompanying drawings. The components in the drawings are not necessarily drawn to scale, the emphasis instead being placed upon clearly illustrating the principles of the present bending machine. In the drawings, all the views are schematic.

DETAILED DESCRIPTION

Embodiments of the present disclosure will now be described in detail below, with reference to the accompanying drawings.

Figure 1:
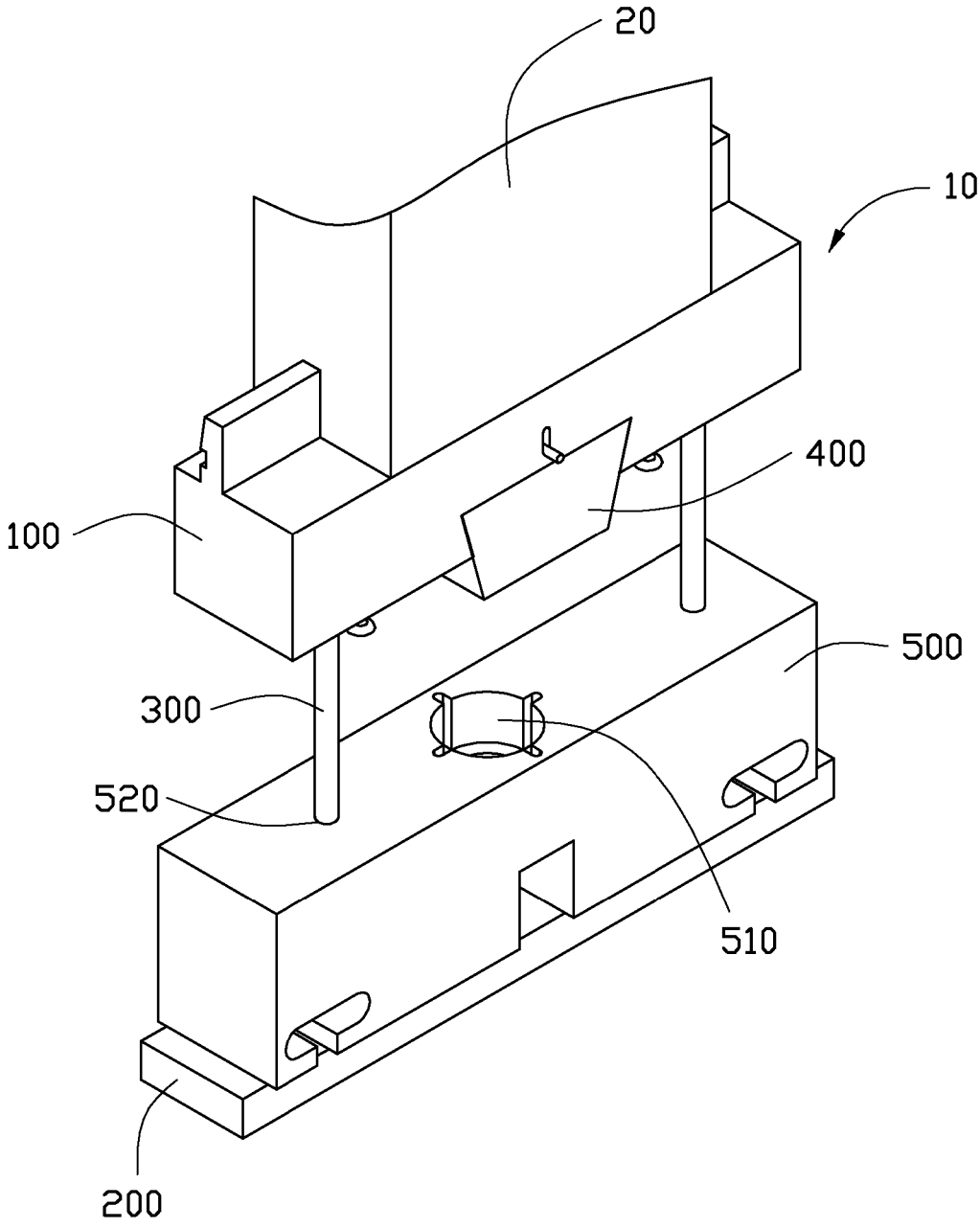
FIG. 1 is a schematic view of a bending machine according to an exemplary embodiment.

Referring to FIG. 1, a bending machine 10, according to an exemplary embodiment, is shown. The bending machine 10 includes an upper bar 20, an upper die holder 100, an operating platform 200, a number of guide posts 300, an upper die clamp 400, and a lower die clamp 500.

Figure 2:
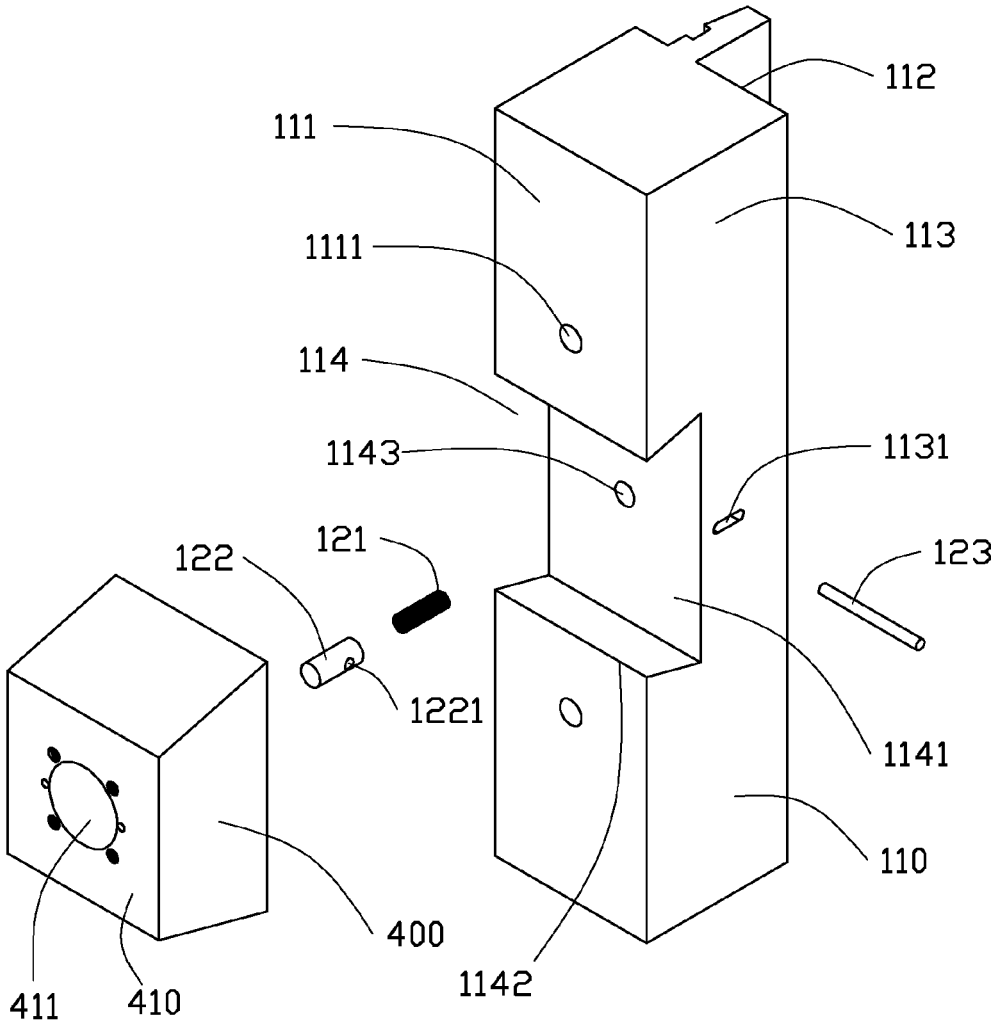
FIG. 2 is a schematic, exploded view of an upper die holder and an upper die clamp of the bending machine of FIG. 1.

The upper die holder 100 is secured on the upper bar 20. The upper die holder 100 is movable towards and away from the operating platform 200 together with the upper bar 20. Further referring to FIG. 2, the upper die holder 100 includes a main body 110, a spring 121, a positioning pin 122, and an operating rod 123.

The main body 110 includes a lower surface 111, a top surface 112, and two opposite side surfaces 113 connecting the lower surface 111 and the top surface 112. The lower surface 111 faces the operating platform 200, and the top surface 112 faces away from the operating platform 200. The two opposite side surfaces 113 are substantially perpendicular to the lower surface 111 and the top surface 112.

The lower surface 111 of the main body 110 defines a sliding groove 114 and a number of first guide holes 1111 thereon. The sliding groove 114 is configured for receiving the upper die clamp 400. The sliding groove 114 runs through the two opposite side surfaces 113 of the main body 110. The sliding groove 114 has a bottom surface 1141 and an opening 1142 opposite to the bottom surface 1141. The bottom surface 1141 of the sliding groove 114 defines a positioning hole 1143. The width of the sliding groove 114 at the bottom of the sliding groove 114 substantially parallel to the side surfaces 113 exceeds the width of the sliding groove 114 at the opening 1142 thereof. In the present embodiment, the sliding groove 114 is a dovetail groove. In other embodiments, the sliding groove 114 can run through only one of the two opposite side surfaces 113.

One of the two side surfaces 113 defines a sliding slot 1131 communicating with the positioning hole 1143. The top surface 112 of the main body 110 is fixed to the upper bar 20.

Figure 3:
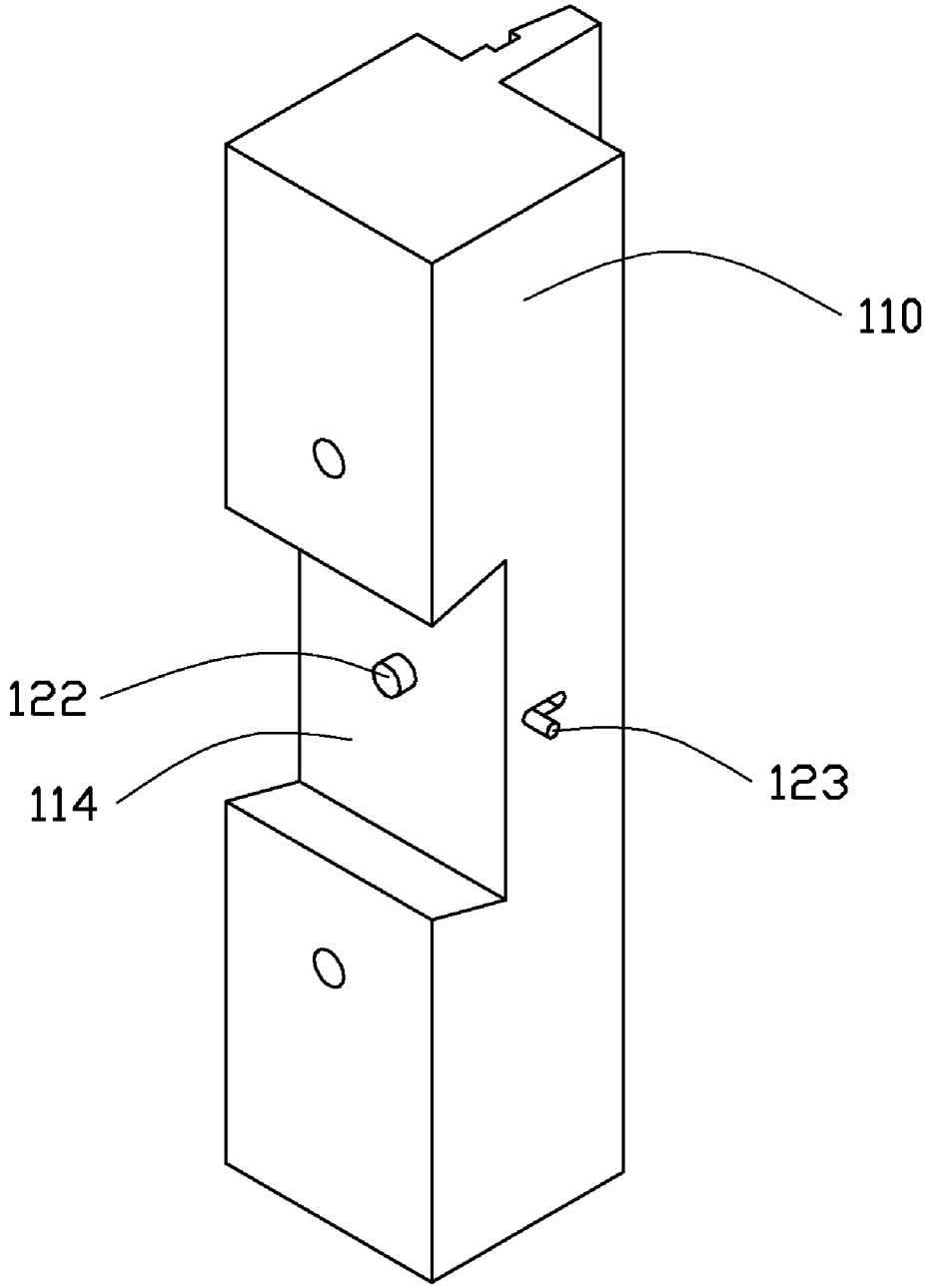
FIG. 3 is a schematic, assembled view of the upper die holder of FIG. 2 securing an upper die clamp.
Figure 4:
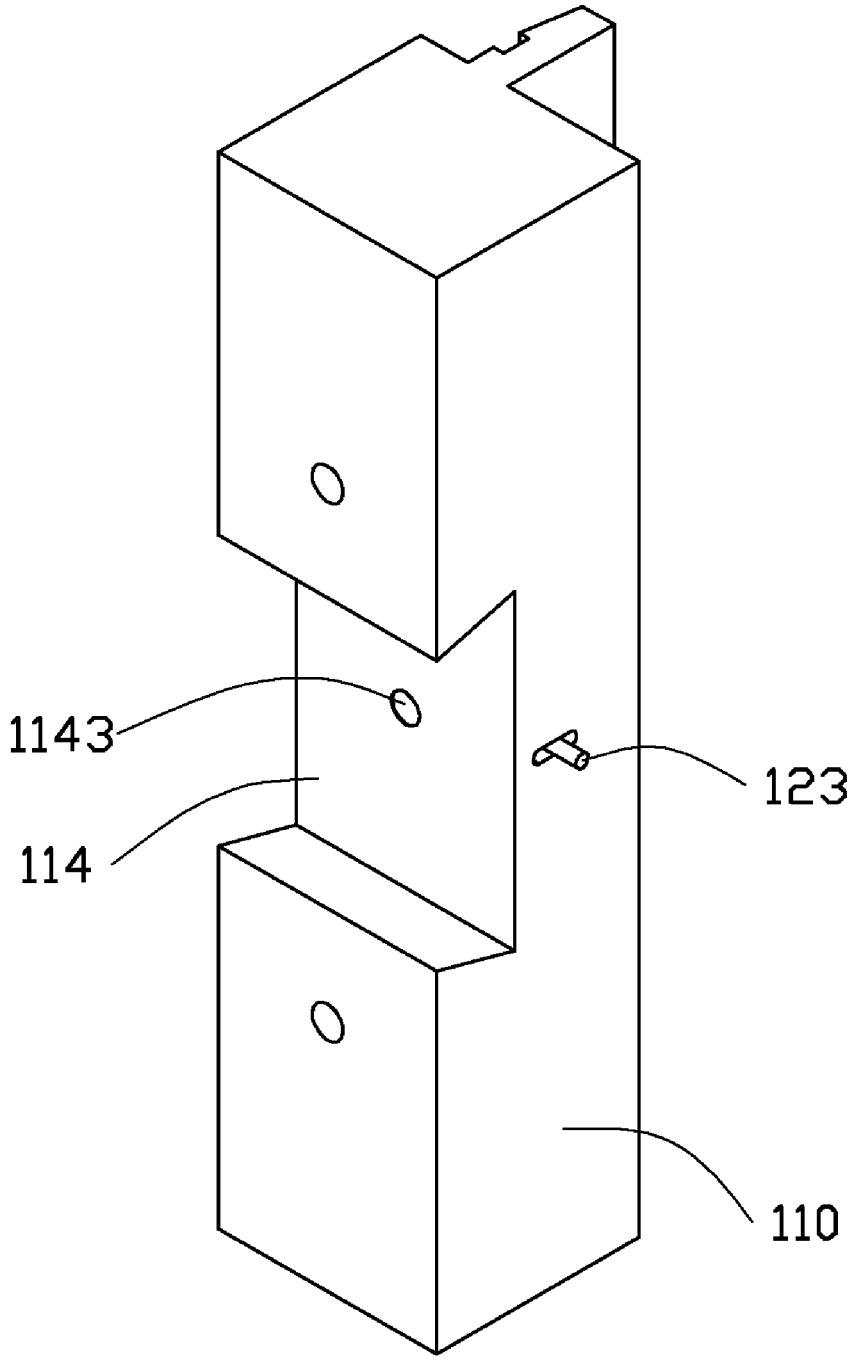
FIG. 4 is a schematic, assembled view of the upper die holder of FIG. 2 situated to allow removal of the upper die clamp therefrom.

The spring 121 and the positioning pin 122 are received in the positioning hole 1143 in sequence. One end of the spring 121 resists the bottom surface (not visible) of the positioning hole 1143, and the other end of the spring 121 resists the positioning pin 122. The positioning hole 1143 defines a latching hole 1221. The operating rod 123 is received in the sliding slot 1131 with one end thereof received in the latching hole 1221 and the other end thereof extending out of the sliding slot 1131. Referring to FIG. 3 and FIG. 4, impelled by the operating rod 123, a part of the positioning pin 122 can be extended out of the positioning hole 1143, and the positioning pin 122 completely received in the positioning hole 1143.

Figure 5:
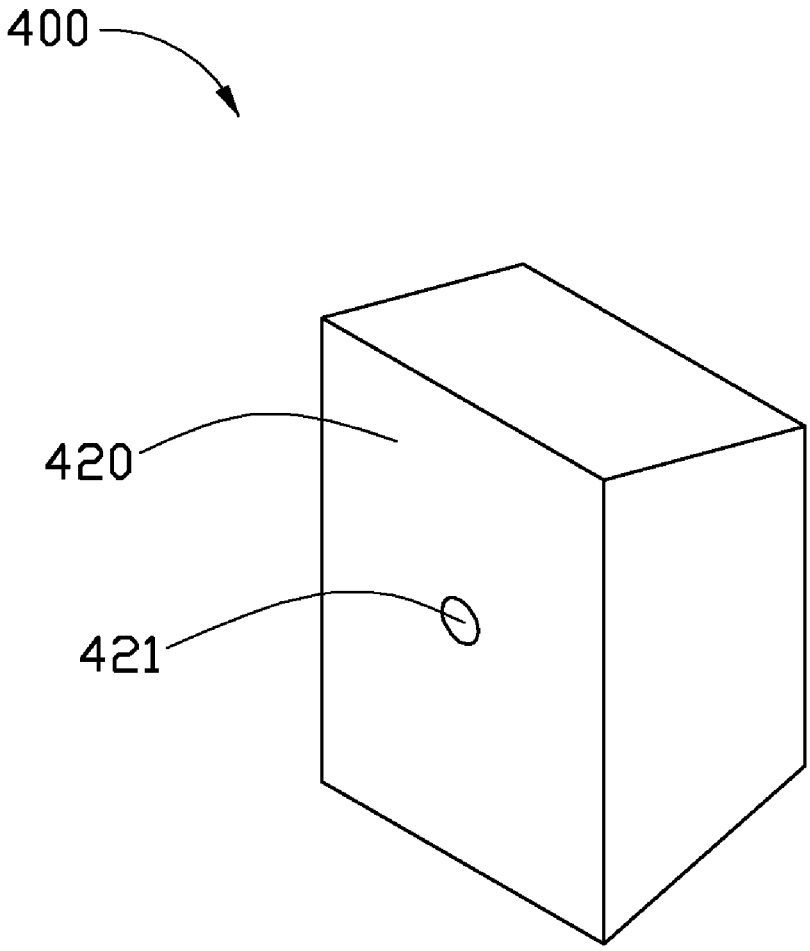
FIG. 5 is a schematic view of the upper die clamp of FIG. 2.

The upper die clamp 400 is received in the sliding groove 114. The upper die clamp 400 is slidable in the sliding groove 114 in directions substantially perpendicular to the side surfaces 113, and is unmovable in directions substantially perpendicular to the lower surface 111 of the main body 110. The upper die clamp 400 includes a bottom surface 410 facing the operating platform 200, and a top surface 420 facing the bottom surface 1141 of the sliding groove 114. In the present embodiment, the bottom surface 410 of the upper die clamp 400 defines an upper die hole 411 for fixing a corresponding upper bending die (not shown). Referring to FIG. 5, the top surface 420 of the upper die clamp 400 defines a pinhole 421 corresponding to the positioning pin 122. The inner diameter of the pinhole 421 is substantially equal to the diameter of the positioning pin 122.

The lower die clamp 500 is placed on the operating platform 200 for fixing a corresponding lower bending die (not shown) thereon. In the present embodiment, the lower die clamp 500 defines a lower die hole 510 for fixing the corresponding lower bending die, and a number of second guide holes 520 corresponding to the first guide holes 1111. The guide posts 300 align the upper die holder 100 with the lower die clamp 500 before bending workpieces.

In the present embodiment, to assemble the upper die clamp 400 to the upper die holder 100, only the upper die clamp 400 needs be received in the sliding groove 114 and the positioning pin 122 received in the pinhole 421 of the upper die clamp 400, impelled by the operating rod 123. In order to disassemble the upper die clamp 400 from the upper die holder 100, the positioning pin 122 need only be withdrawn from the pinhole 421 of the upper die clamp 400, again impelled by the operating rod 123, and the upper die clamp 400 withdrawn from the sliding groove 114. Accordingly, the upper die clamp 400 can be assembled to or removed from the upper die holder 100 conveniently, allowing convenient replacement of the upper bending die.

While certain embodiments have been described and exemplified above, various other embodiments will be apparent to those skilled in the art from the foregoing disclosure. The invention is not limited to the particular embodiments described and exemplified, and the embodiments are capable of considerable variation and modification without departure from the scope and spirit of the appended claims.

What is claimed is:

1. A bending machine comprising:

an upper bar;

an operating platform;

a lower die clamp received on the operating platform;

an upper die holder movable towards and away from the operating platform, the upper die holder comprising:

a main body comprising a top surface fixed to the upper bar, a lower surface opposite to the top surface and facing the operating platform, and two opposite side surfaces, the lower surface defining a sliding groove running through the two opposite side surfaces, the sliding groove comprising a bottom surface having a positioning hole defined therein, and one of the two opposite side surfaces defining a sliding slot communicating with the positioning hole;

a positioning pin received in the positioning hole, the positioning pin defining a latching hole therein;

a spring received in the positioning hole with one end thereof resisting the bottom surface of the positioning hole and the other end thereof resisting the positioning pin; and an operating rod received in the sliding slot with one end thereof received in the latching hole and the other end thereof extending out of the sliding slot; and an upper die clamp slidable in the sliding groove, a surface of the upper die clamp facing the bottom surface of the sliding groove defining a pinhole corresponding to the positioning pin.

2. The bending machine of claim 1, wherein the two opposite side surfaces are substantially perpendicular to the lower surface of the main body.

3. The bending machine of claim 2, wherein the upper die clamp is slidable in the sliding groove in directions substantially perpendicular to the side surfaces, and is unmovable in directions substantially perpendicular to the lower surface of the main body.

4. The bending machine of claim 1, wherein the width of the sliding groove at an opening thereof opposite to the bottom surface thereof is less than the width of the sliding groove at the bottom surface thereof

5. The bending machine of claim 4, wherein the sliding groove is a dovetail groove.

6. The bending machine of claim 1, wherein the inner diameter of the pinhole of the upper die clamp is substantially equal to the diameter of the positioning pin.

7. The bending machine of claim 1, further comprising a plurality of guide posts, wherein each of the upper die holder and the lower die clamp defines a plurality of guide holes corresponding to the guide posts.

8. The bending machine of claim 1, wherein the upper die clamp defines an upper die hole in a surface thereof opposite to the surface defining the pinhole.

9. The bending machine of claim 1, wherein the lower die clamp defines a lower die hole in a surface thereof facing the upper die holder.

10. A bending machine comprising:

an upper bar;

an operating platform; and an upper die holder movable towards and away from the operating platform, the upper die holder comprising:

a main body comprising a top surface fixed to the upper bar, a lower surface opposite to the top surface and facing the operating platform, and two opposite side surfaces, the lower surface defining a sliding groove running through the two opposite side surfaces and receiving an upper die clamp, the sliding groove having a bottom surface defining a positioning hole therein, and one of the two opposite side surfaces defining a sliding slot communicating with the positioning hole;

a positioning pin received in the positioning hole, and defining a latching hole therein;

a spring received in the positioning hole with one end thereof resisting the bottom surface of the positioning hole and the other end thereof resisting the positioning pin; and an operating rod received in the sliding slot with one end thereof received in the latching hole and the other end thereof extending out of the sliding slot.

11. The bending machine of claim 10, wherein the two opposite side surfaces are substantially perpendicular to the lower surface of the main body.

12. The bending machine of claim 10, wherein the sliding groove comprises an opening opposite to the bottom surface thereof, and the width of the sliding groove at the bottom of the sliding groove exceeds the width of the sliding groove at the opening of the sliding groove.

13. The bending machine of claim 12, wherein the sliding groove is a dovetail groove.

14. The bending machine of claim 10, wherein the upper die clamp defines an upper die hole in a surface thereof facing the operating platform.

15. The bending machine of claim 10, further comprising a lower die clamp received on the operating platform, wherein the lower die clamp defines a lower die hole in a surface thereof facing the upper die holder.

* * * * *